US005772061A

United States Patent [19]

Lowe

[11] Patent Number: 5,772,061

[45] Date of Patent: Jun. 30, 1998

[54] REFUSE CONTAINERS

[75] Inventor: Peter Lowe, Brieley Hill, England

[73] Assignee: Egbert H. Taylor & Company Limited, England

[21] Appl. No.: 571,810

[22] Filed: Dec. 13, 1995

[30] Foreign Application Priority Data

Dec. 15, 1994 [GB] United Kingdom ..... 9425307
Aug. 23, 1995 [GB] United Kingdom ..... 9517201

[51] Int. Cl.[6] ..... B65D 51/18

[52] U.S. Cl. ..... 220/331; 220/338; 220/908; 220/333

[58] Field of Search ..... 220/333, 331, 220/908, 338

[56] References Cited

U.S. PATENT DOCUMENTS 4,155,584 5/1979 Pracchia .
4,290,352 9/1981 Schmidt .
5,094,487 3/1992 Drewry .
5,165,564 11/1992 Prout .
5,224,744 7/1993 Michelutti .
5,360,132 11/1994 Edelhoff .

FOREIGN PATENT DOCUMENTS 2269801 2/1994 United Kingdom .

*Primary Examiner*—Joseph M. Moy
*Attorney, Agent, or Firm*—Jones & Askew, LLP

[57] ABSTRACT

A gravity catch for a refuse container allows the lid to open only when the container is upended for emptying. The catch includes a sliding/rolling locking member which is also the gravity element.

18 Claims, 6 Drawing Sheets

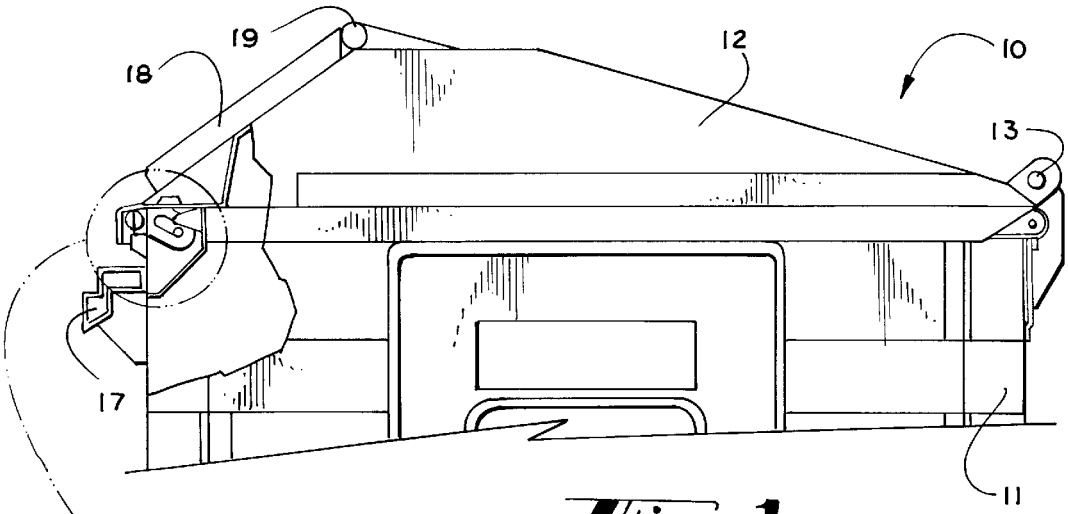
Fig_1
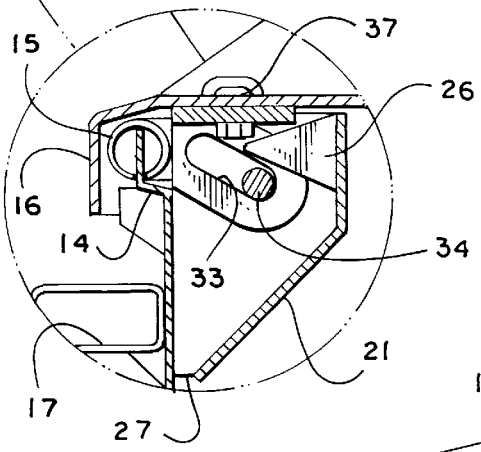
Fig_2
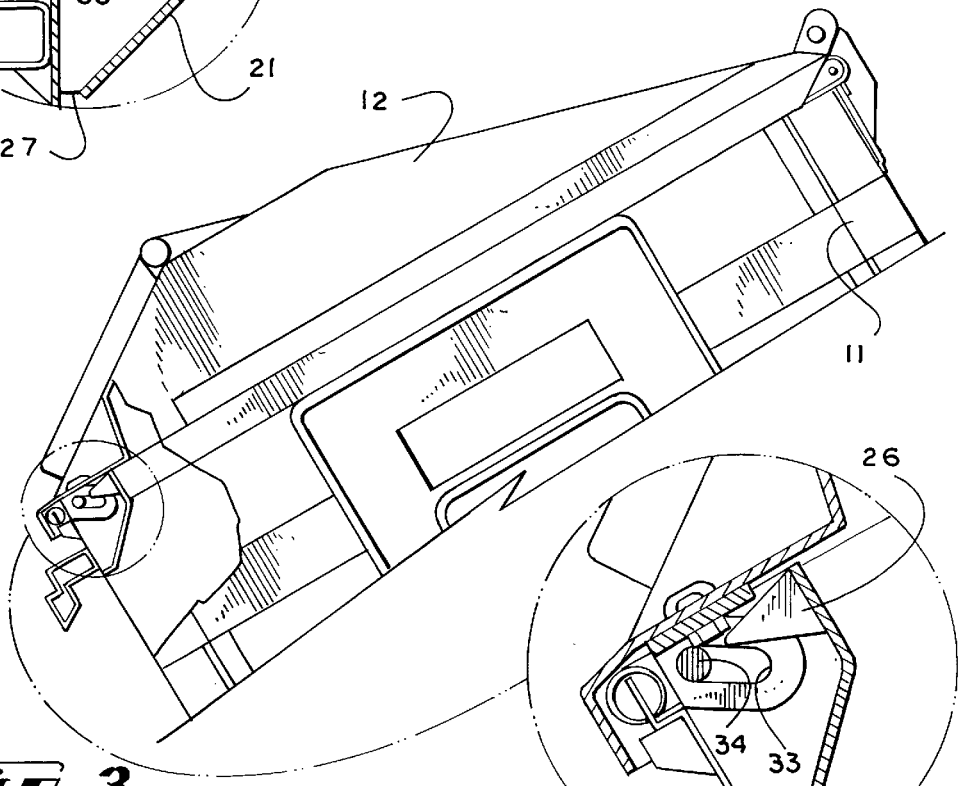
Fig_3
Fig_4

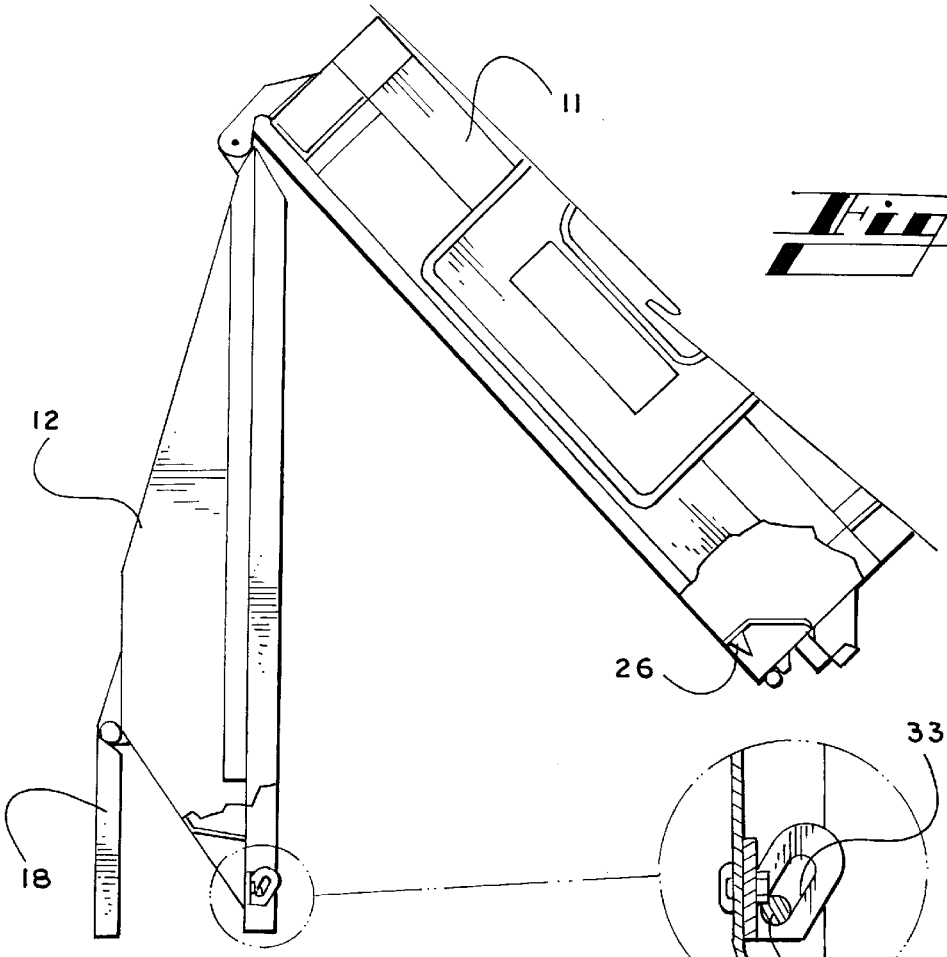
Fig. 5
Fig. 6
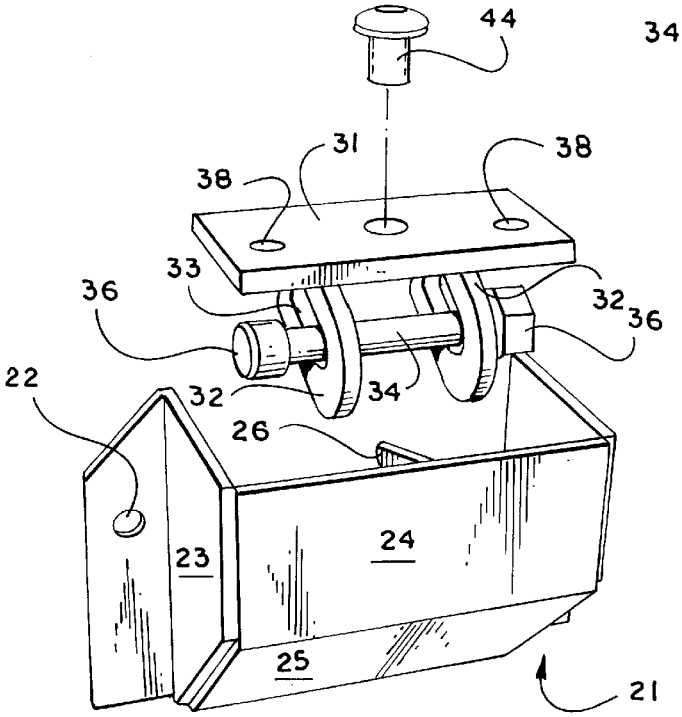
Fig. 7

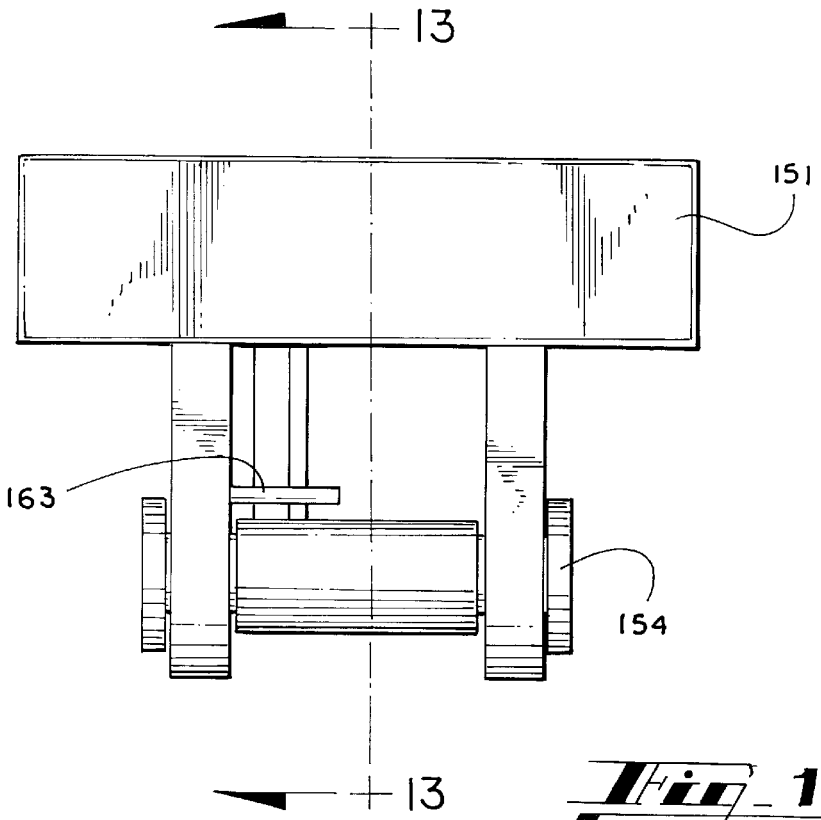
Fig. 12
Fig. 13
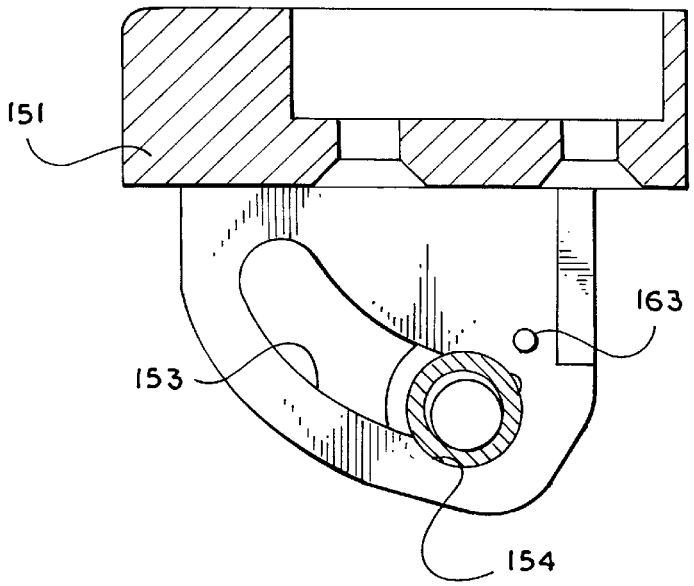

REFUSE CONTAINERS

This invention relates to an improved refuse container, and particular to the hinged lid of a wheeled refuse container.

Wheeled refuse containers have replaced the traditional dustbin both for domestic and commercial rubbish. Typically such a container is square or rectangular in section and has a lifting bar at the front edge for engagement by a lifting and tipping mechanism of a dustcart. Such containers are normally provided with lids which are hinged so as to permit opening from the front edge; usually the lid is hinged about the upper rear edge of the container or moves arcuately on opposed arms pivoted on the sides of the container.

In order to ensure efficient emptying of this kind of container, the lid usually opens over substantially the entire cross-sectional notwithstanding that a much smaller opening would usually suffice for loading the container with refuse. Container lids are heavy and thus the provision of smaller secondary openings is not uncommon, especially for where such containers are used for the collection of glass bottles or cans.

It has been realised that a restriction of the size of the loading opening has other advantages since it can prevent the dumping of unsuitable items such as televisions into the container. Furthermore small children are prevented from climbing into the container where they may injure themselves or become trapped if the lid closes over them.

Necessarily such containers require a lock for the primary lid, and hitherto refuse collectors have been required to unlock the lid prior to emptying, and to lock the lid subsequently. This procedure is time consuming and in practice is unreliable because for example the collector may lose the key. What is required is an automatic lock suitable for use with all kinds and sizes of containers and which is not restricted to particular lifting mechanisms.

Pendulum latches are known whereby a pendulum directly or indirectly causes latching of a lid to a container in the upright condition. In use as the container is upended the pendulum causes the lid to be released thereby allowing the contents of the container to be emptied.

Pendulum latches are disadvantageous since they require careful assembly to ensure free movement without jamming, a relatively close fitting bore and pivot pin require to he machined. The necessary pivot is susceptible to seizure in use and must be strong to support the weight of the pendulum, which is usually cantilevered. Such mechanisms are also rather bulky because of the need to accommodate a swinging arm. If incorporated within the container pendulum latches reduce the available space significantly; if placed on the outside they are susceptible to tampering and impact damage. The pendulum may also cause unnecessary noise by virtue of hitting the container at the end of its travel, such noise may be obtrusive especially where the container is of metal and thus amplifies the sound.

According to the invention there is provided a refuse container comprising a bin having a lid hinged thereon and movable between open and closed conditions, the lid having a secondary opening therein, and a catch between the bin and the lid, the catch comprising an abutment on one of the bin and lid, and a locking member on the other of the bin and lid, the locking member being a gravity element and moveable in translation to engage the abutment thereby to hold the lid in the closed condition when the container is upright, and being disengageable under the action of gravity as the container is upended for emptying. The movement of such a gravity element is automatic, and preferably occurs only after the container has been pivoted through a substantial angle. The catch may for example operate after pivoting of the container through an angle exceeding 25°.

In the preferred embodiment the locking member is a cylindrical rolling element or sliding element.

Such a locking member is less susceptible to jamming since it can be guided with relatively large clearances. Furthermore the catch is compact since the swinging arc of a pendulum is avoided, and the number of moving parts is reduced to one.

The invention has the advantage that the catch cannot be released whilst the container is upright and thus access to children and for dumping unauthorised large objects is prevented.

Preferably the catch is adapted to engage at all stable upright conditions in use. This arrangement ensures automatic locking of the lid as the container is lowered at the end of an emptying cycle. The lid cannot be left in the open condition since relatching is automatic and the invention thus has the further advantage that rain water is excluded, and smells are contained. Means may be provided whereby the catch can be released when inspection of an upright container is required, the catch automatically engaging when the lid is reclosed.

In a preferred embodiment the abutment is provided on the container and the locking member on the lid. This arrangement has the particular advantage that the locking member cannot be damaged as refuse is tipped out of the container over the loading lip since the lid hangs away from the loading lip In this way the moving part of the catch is kept away from refuse, and can thus be maintained in an unfouled condition. Nevertheless the catch is within the bin where it is protected from weather and tampering. In a preferred embodiment the abutment comprises a plate like projection of the container, the plane of the projection being substantially vertical.

The locking member preferably comprises a rolling or sliding element housed in a cage attached to the lid. The element is preferably relatively heavy and may comprise a solid metal cylinder in slots of a cage. in the preferred embodiment the cage comprises a substantially U-shaped member having a web and two flanges, the web being attached to the underside of the container lid, and the flanges defining opposite aligned slots for the cylinder. Preferably the cylinder is retained in the cage by external enlarged heads. The locking element may roll or slide or perform a combination of both movements.

In the preferred embodiment the slots extend downwardly and rearwardly of the container. In one embodiment the slots are straight and at an angle exceeding 25° to the horizontal when the lid is in the closed condition. In another embodiment the slots are arcuate. The abutment may extend outwardly from a secondary inner wall of the container, the secondary wall defining an enclosure for the catch.

Such an enclosure prevents damage to the catch during container filling, and also jamming of the catch should the container be filled to capacity. Preferably the lower wall of the enclosure is angled toward the container wall thereby to ensure that rubbish within the container is not trapped during emptying.

The cage may be of metal but is preferably a moulded plastic part. A plastics cage eliminates noise, is not susceptible of corrosion damage, can provide a self lubricating track for the locking element, and can be manufactured very economically in quantity.

In a preferred embodiment the lower surface of the projection is preferably at an angle less than the angle of said slot when the lid is in the closed condition. The lower surface may be generally horizontal.

Preferably the upper surface of the projection is angled downwardly of the container, the outer edge of the projection being inward of the outer and of the slot by at least the diameter of the cylinder. In a preferred embodiment the projection is in the shape of an arrow head, the apex of which is aligned with the upper end of the slot.

The device may further include a key insertable therein to move the locking member to a released condition. In a preferred embodiment the key includes a cam face to directly move the locking member as the key is inserted. The cam face may be an end face of the key.

In a preferred embodiment the catch comprises flanged members connected to each other through an aperture of the container lid. Such an arrangement allows the catch to be firmly fixed to the lid. Preferably the catch comprises an inner member having the locking member, and an outer member comprising a lock barrel. The lock barrel may be substantially cylindrical and have a serpentine key slot. In use a key of corresponding shape is insertable in the key slot to move the locking member to a released condition.

The lock barrel and inner member are preferably both moulded in plastic. Preferably the barrel is insertable into the inner member and has a flat or other external discontinuity to register within a corresponding aperture of the lid.

In a preferred embodiment the inner member includes an obstruction immediately above the locking member in its rest condition, and a key includes a slot to receive the obstruction. Preferably the obstruction is a cylindrical pin of substantially smaller diameter than the locking member. Such an arrangement advantageously prevents unauthorized movement of the locking member to release the catch.

Other features of the invention will be apparent from the following description of preferred embodiments shown by way of example only in the accompanying drawings in which:

FIG. 1 is a partial side elevation of a refuse container incorporating the invention showing the latch mechanism in section.

FIG. 2 is an enlarged view of the sectioned portion of FIG. 1.

FIG. 3 is a partial side elevation corresponding to FIG. 1 and showing the container partially upended.

FIG. 4 is an enlarged view of the sectioned portion of FIG. 4.

FIG. 5 is a partial side elevation corresponding to FIG. 1 and FIG. 3 showing the container fully upended.

FIG. 6 is an enlarged view of the sectioned portion of FIG. 5.

FIG. 7 is an exploded isometric view of the catch from the rear and one side.

Figure 10:
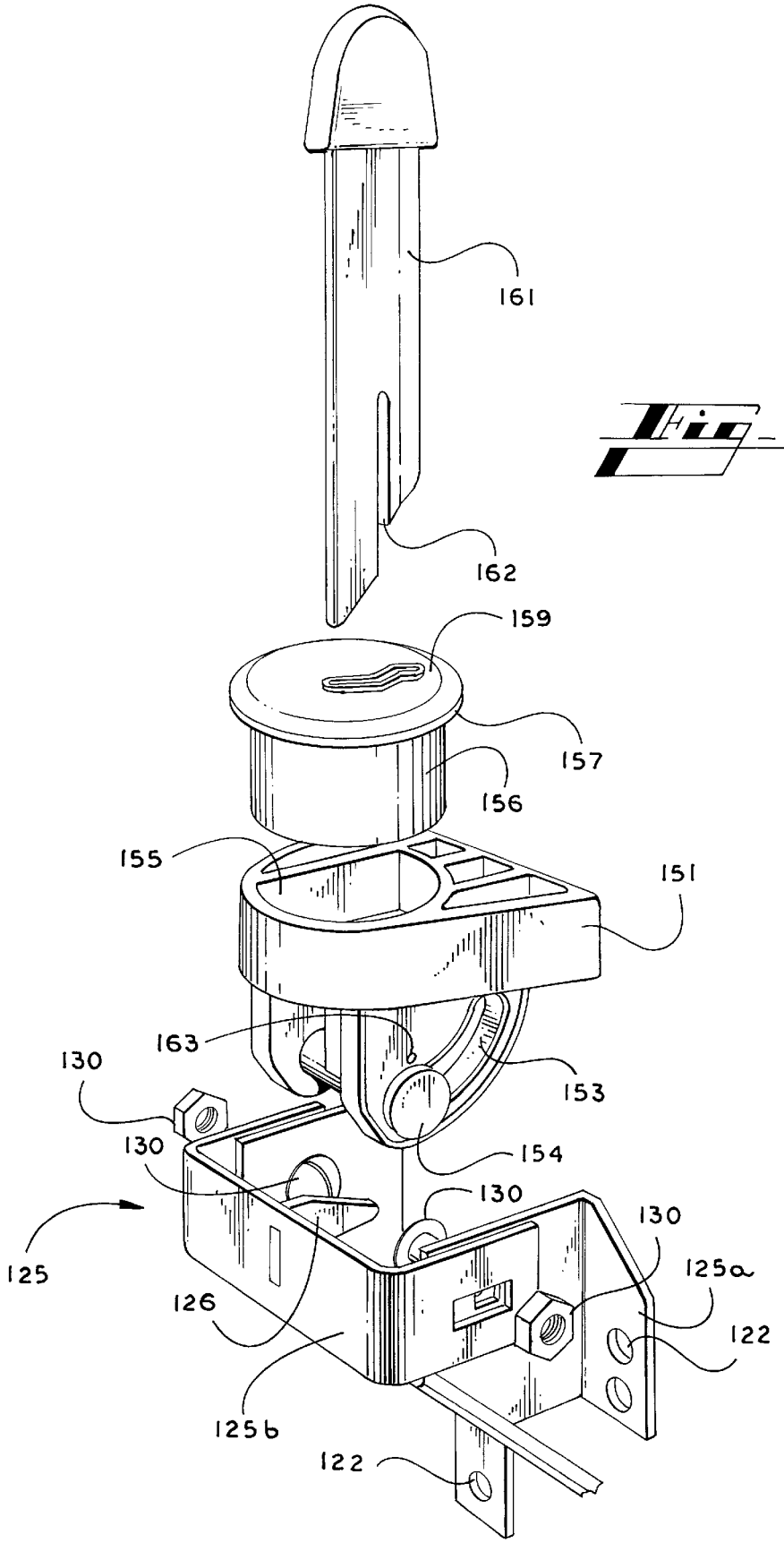
FIG. 10 is an isometric view from one side of an alternative catch and key arrangement.
Figure 11:
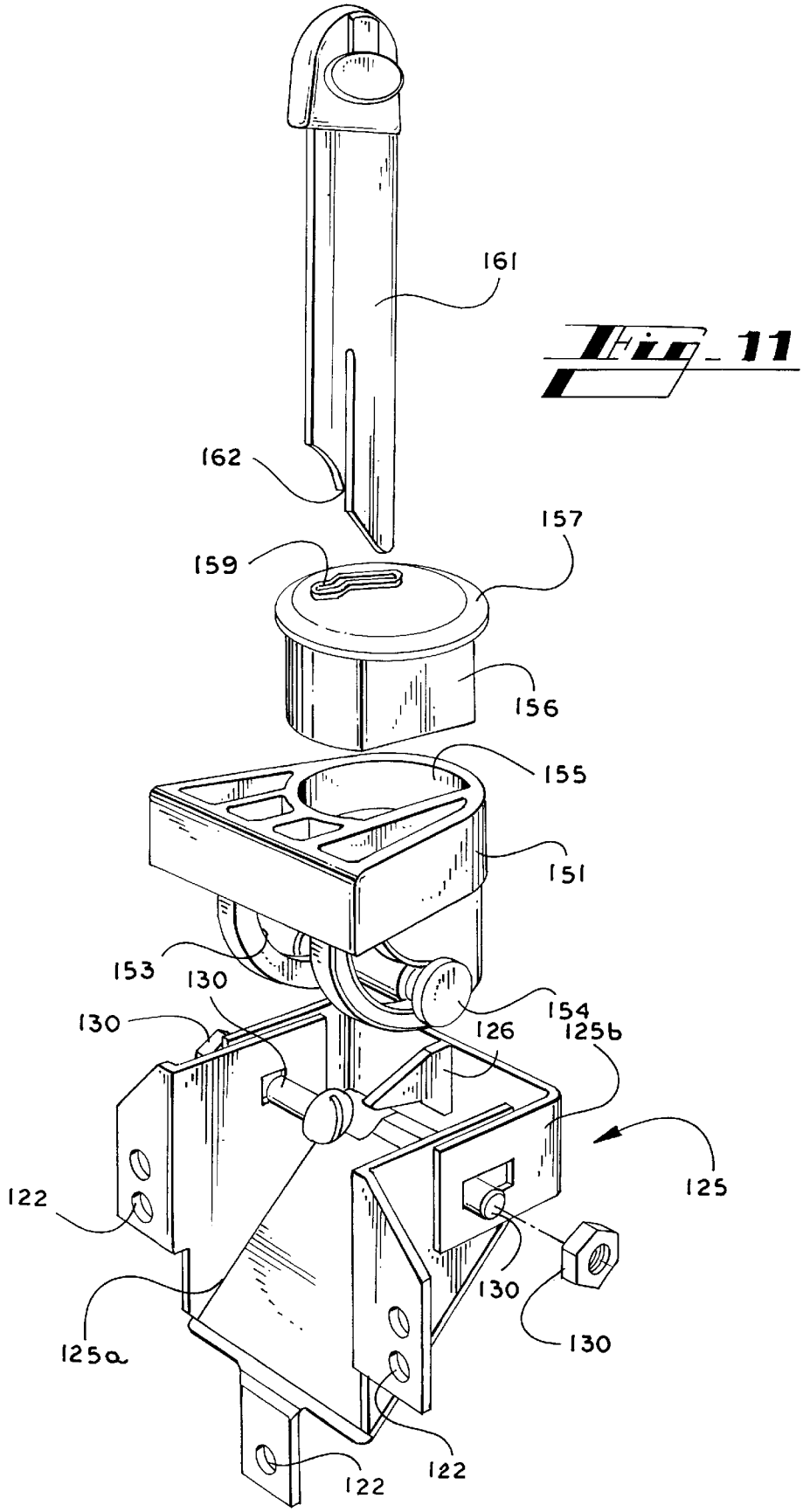

FIG. 11 corresponds to FIG. 10 but viewed from the other side.

FIG. 12 is an elevation of the catch body of FIGS. 10 and 11.

FIG. 13 is a transverse section through FIG. 12 on line A—A.

With reference to the drawings a conventional refuse container 10 comprises an open rectangular bin 11 having a height of about 1.5 times the depth and a width slightly greater than the height. Castors (not shown) are fitted to corners so that the container can be manoeuvred. The container illustrated has a typical capacity of about 1100 litres and is of steel.

A lid 12 is hinged at the rear of bin 11 about a hinge axis 13; FIG. 1 shows the lid 12 in the closed condition. A secondary opening to the lid comprises a cover 18 hinged about an axis 19.

As best illustrated in FIG. 2 the wall 14 of the container is stiffened at its upper edge by a split tube 15 secured in any suitable manner. The lid 12 rests on the tube 15 and has a rim 16 which overlaps the wall on the front and side edges of the container; the rim is cut away at the back to allow the lid to open. A lifting flange 17 is fixed to the front edge of the container and is engaged from above and below by jaws of a conventional dustcart lifting mechanism (not shown). The lifting mechanism may alternatively engage side mounted trunnions of the container.

Figure 8:
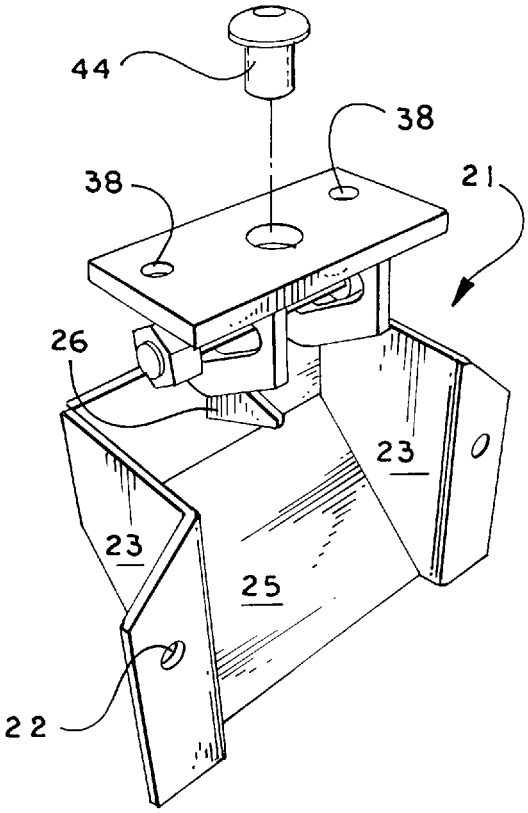
FIG. 8 is an exploded isometric view of the catch from the front and the other side.

With additional reference to FIGS. 7 and 8, an enclosure 21 is fixed at the top of the inner front wall of the container, for example by bolts passing through the container wall and apertures 22; the enclosure may alternatively be attached by welding.

The enclosure comprises opposed side walls 23 perpendicular to the front wall of the container, a rear wall 24 parallel to the front wall, and a downwardly and outwardly sloping base 25. An arrow head projection 26 extends outwardly from the middle of the rear wall 24 and adjacent to the top edge thereof. The enclosure 21 includes a drain aperture 27 at the base thereof.

A plate 31 attached to the underside of the lid so as to fall within the enclosure 21 has depending slotted arms 32 symmetrically arranged on either side; the slots 33 extend downwards and to the rear at an angle of about 35° to the horizontal. A cylindrical locking member 34 extends somewhat loosely through the slots and has enlarged external heads 36 to prevent disengagement therewith. The cylindrical member may be a steel bar threaded at one end to receive a nut. As illustrated the plate may be secured to the lid by bolts 37 or the like extending through bolt holes 38.

In use, as illustrated in FIG. 2, the member 34 falls under gravity to the inner end of the slots 33 when the lid is in the closed condition.

In initial closure of the lid 12, the member 34 rests on the upper surface of the projection 26. The weight of the lid and the downwards slope of the upper side of the projection 26 cause the member 34 to roll or slide towards the upper end of the slots 33 until the apex of the projection is cleared. At this point the lid drops into the fully closed condition, and the member 34 rolls under the projection 26, thus preventing the lid from being re-opened by lifting the front edge thereof.

In this condition refuse can be inserted into the container only through the secondary opening provided by lid 18.

FIG. 3 illustrates the container when partially upended for emptying. The container is at an angle at which the axis of the slots 33 are just past the horizontal, and the member 34 has rolled to the outer end of the slots. At this point the lid is in a condition to open, but does not do so until the container has rotated through 90°.

FIG. 5 illustrates the container in the fully upended condition after rotation through about 135°. Both primary and secondary lids hang vertically, and in use refuse falls over the front edge of the container. The angled base 25 of the enclosure ensures that refuse is not trapped in a recess. The lid hangs away from the front edge of the container.

A removable plug 41, which extends through the lid 12 and plate 31, permits a tool to be inserted which can manually push the member 34 to the outer end of the slots 33; this permits access for inspection whilst the container is upright, and permitting a jammed latch to be released. The plug may be screw-threaded into the plate 31 and may have a socket head adapted to be opened only by a key spanner.

Figure 9:
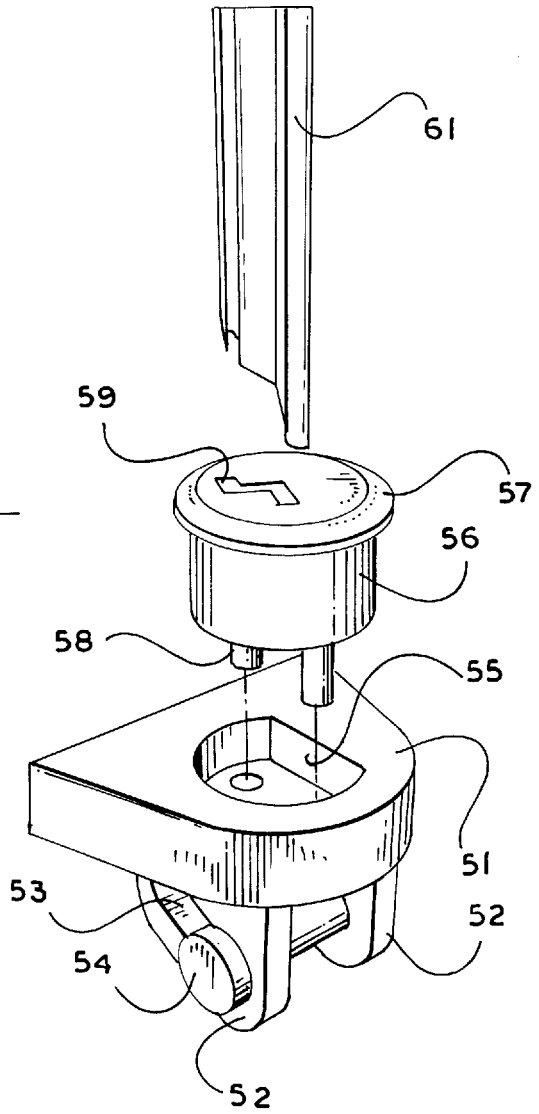
FIG. 9 is an isometric view of an alternative catch and key arrangement.

An alternative embodiment is illustrated in FIG. 9. A catch body 51 is preferably moulded in plastics material and includes two slotted arms 52 which correspond to the arms 32 of the first embodiment. A cylindrical locking member 54 slides loosely in the slots 53 in the manner of the first embodiment and is intended for engagement with a container projection such as arrow head projection 26.

The upper face of body 51 includes a D shaped recess 55 adapted to receive a D shaped lock barrel 56 having a upper flanged edge 57. The D) shape ensures location of the barrel 56 within the body 51 and obviates relative rotation. The lock barrel is also preferably of plastics.

In use the body 51 is placed on the underside of a container lid and the barrel 56 inserted from the outside through an aperture in the lid wall which is preferably D shaped to ensure correct registration of the parts. The flange 57 ensures that the container lid is securely sandwiched, and the barrel is secured to the body e.g. by studs 58 which pass through corresponding apertures of the body and receive nuts. The body and barrel may alternatively be secured by screws, welding, adhesive or any other suitable means.

The barrel 56 includes a serpentine aperture 59 to receive a key 61 of corresponding shape. The tip of the key is tapered so that insertion through the aperture 59 causes engagement with the locking member 54 and camming movement of the locking member upwardly of the slots 53 to disengage a lock projection, such as arrow head projection 26.

Insertion of the key thus permits the lid to be opened, as previously described with reference to the plug 41, but the serpentine key slot prevents the lid being opened by unauthorised means such as knife blades, screwdrivers or bent wires. Moreover replacement of the lock barrel with a slot of different shape is possible if the barrel becomes damaged. Furthermore the use of a separate lock barrel permits several key shapes which may offer increased container security in specific applications or for specific users.

FIGS. 10–13 illustrate an alternative arrangement similar to FIG. 9.

An injection moulded catch body 151 is adapted to receive a D shaped lock barrel 156 as previously described, thereby sandwiching a container lid (not shown).

The body 151 defines curved slots 153 within which is accommodated a locking member 154. The curve of the slots ensures that the locking member moves smoothly around the lock projection 126 when released by a key 161 or when dropping into place on closure of the lid. The underside of the projection 126 is generally horizontal as illustrated.

The enclosure 121 comprises sheet metal components 125*a* and 125*b* which are bent from flat stock as illustrated, and secured together by nuts and bolts 130 which are shown schematically. Apertures 122 permit the enclosure to be attached to the front wall of a refuse container.

The key 161 includes a slot 162 which in use accommodates cylindrical projection 163 provided as an anti-picking device. The projection 163 lies above the locking member 154 in its rest condition on the axis of movement of the key, and prevents movement of the locking member by a blade bent to assume the serpentine shape of the slot 159. Such a lock is particularly secure.

Variations to the invention are possible within the scope of the claims appended hereto. For example, the key 161 may have any suitable shape or cross-section and need not necessarily be serpentine. The enclosure may be of a synthetic material, and the locking element may be of any suitable material or composite provided it is sufficiently heavy to act as an effective gravity element.

I claim:

1. A refuse container comprising a bin having a lid hinged thereon and movable between open and closed conditions;

the lid having a secondary opening therein and a catch between the bin and the lid;

the catch comprising an abutment on one of the bin and lid, and a locking member on the other of the bin and lid;

means associated with the container and defining an open surface of predetermined extent, the open space loosely receiving the locking member so as to guide movement of the locking member by gravity between a first position in the open space when the bin is upright and a second position in the open space when the bin is upended for emptying; and the locking member in the first position engaging the abutment thereby to hold the lid in the closed condition when the bin is upright, and the locking member in the second position disengaging the abutment and thereby allowing the lid to open as the bin is upended for emptying.

2. A container according to claim 1 wherein the locking member is a rolling element.

3. A container according to claim 1 wherein the locking member is a sliding element.

4. A container according to claim 1 wherein the locking member is cylindrical and guided in opposite slots of a cage.

5. A container according to claim 4 wherein the locking member has enlarged heads at opposite ends thereof and outboard said slots.

6. A container according to claim 4 wherein said cage is substantially U shaped and comprises a web adapted to be secured to one of said lid and container and opposite flanges defining said slots.

7. A container according to claim 4 wherein said slots are arcuate.

8. A container according to claim 4 wherein said cage is provided on said lid.

9. A container according to claim 8 wherein said cage is mounted on the underside of said lid and secured by external means passing through said lid.

10. A container according to claim 9 wherein said external means comprise a barrel engaged in a recess of said cage and having an external flange engaged with the outer surface of said lid, said barrel defining a slot adapted to receive a release key for said locking member.

11. A container according to claim 10 wherein said release key is insertable vertically of the container and includes a cam face adapted to move said locking member to a disengaged condition.

12. A container according to claim 11 wherein said barrel includes a serpentine slot to receive said key, and said key is adapted to said slot.

13. A container according to claim 12 wherein an obstruction is provided between said locking member when in the closed condition and said slot, said key including means to circumvent said obstruction.

14. A container according to claim 13 wherein said obstruction comprises a pin extending over such said locking member, and a channel is provided in the key to receive the pin.

15. A container according to claim 10 wherein said barrel and cage are plastics mouldings.

16. A container according to claim 7 wherein said abutment is planar and projects towards the outer wall of the container, the plane of the projection being substantially vertical in use.

17. A container according to claim 16 wherein said projection is substantially triangular with the apex towards said container wall.

18. A container according to claim 17 wherein the upper edge of said projection is downwardly sloping when the container is upright.

* * * * *